US007357679B2

(12) United States Patent
Wang

(10) Patent No.: US 7,357,679 B2
(45) Date of Patent: Apr. 15, 2008

(54) CABLE CONNECTOR WITH IMPROVED TERMINALS

(75) Inventor: Yaojun Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/599,747

(22) Filed: Nov. 14, 2006

(65) Prior Publication Data

US 2007/0059987 A1 Mar. 15, 2007

Related U.S. Application Data

(63) Continuation of application No. 11/001,854, filed on Dec. 1, 2004, now Pat. No. 7,134,916.

(30) Foreign Application Priority Data

Dec. 25, 2003 (CN) ..... 2003 2 0123567 U

(51) Int. Cl.
*H01R 24/00* (2006.01)

(52) U.S. Cl. ..... 439/660; 439/607; 439/701

(58) Field of Classification Search ..... 439/660, 439/108.98, 579, 903, 606–610, 395, 874, 439/404, 135, 521, 695, 701, 686, 604
See application file for complete search history.

(56) References Cited

U.S. PATENT DOCUMENTS 6,231,393 B1 * 5/2001 Lai ..... 439/610
6,722,898 B2 * 4/2004 Peloza et al. ..... 439/108

* cited by examiner

*Primary Examiner*—Edwin A. Leon
(74) *Attorney, Agent, or Firm*—Wei Te Chung

(57) ABSTRACT

A cable connector (1) includes an insulative housing (10), a number of terminals (20) and a cable (60). The insulative housing includes a base portion (12) and a tongue (14) extending from the base portion. The terminals are received in the insulative housing. Each terminal comprises a contacting portion (21) and an opposite tail portion (22). The contacting portion is located on the tongue, and the tail portion extends beyond the insulative housing. The tail portions of adjacent terminals are different from each other. Each tail portion defines a soldering portion (24) thereon. The cable has conductors (61) soldered to corresponding soldering portions of the tail portions, and the soldering portions are at different height.

20 Claims, 7 Drawing Sheets

CABLE CONNECTOR WITH IMPROVED TERMINALS

This application is a continuation application of the patent application Ser. No. 11/001,854 filed Dec. 1, 2004, now U.S. Pat. No. 7,134,916.

BACKGROUND OF THE INVENTION

1. Field of the Invention

The present invention generally relates to an electrical cable connector, and particularly to an electrical cable connector with an improved terminal structure.

2. Description of Prior Art

Nowadays, the size of electrical cable connectors is required to be reduced to meet the miniaturization requirement of the development of the computer. Since terminals of the electrical cable connector are normally in a same plane, the distance between adjacent terminals is becoming small, and soldering conductors of a cable to the terminals thus becomes more and more difficult.

U.S. Pat. No. 6,358,088 discloses an electrical cable connector having an insulative housing with a plurality of staggered terminal channels, whereby, solder tails of the terminals are staggered with each other. However, the staggered terminal channels are difficult to form and thus increase the production cost.

Hence, it is desirable to have an improved terminal structure to overcome the above-mentioned disadvantages of the prior art.

BRIEF SUMMARY OF THE INVENTION

Accordingly, it is the object of the present invention to provide a cable connector which has improved terminals for facilitating soldering with conductors of a cable.

In order to achieve the above-mentioned object, a cable connector in accordance with the present comprises an insulative housing, a plurality of terminals and a cable. The insulative housing comprises a base portion and a tongue extending from the base portion. The terminals are received in the insulative housing. Each terminal comprises a contacting portion and an opposite tail portion. The contacting portion is located on the tongue, and the tail portion extends beyond the insulative housing. The tail portions of adjacent terminals are different from each other. Each tail portion defines a soldering portion thereon. The cable has conductors soldered to the soldering portions of the tail portions, and the soldering portions are at different height.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
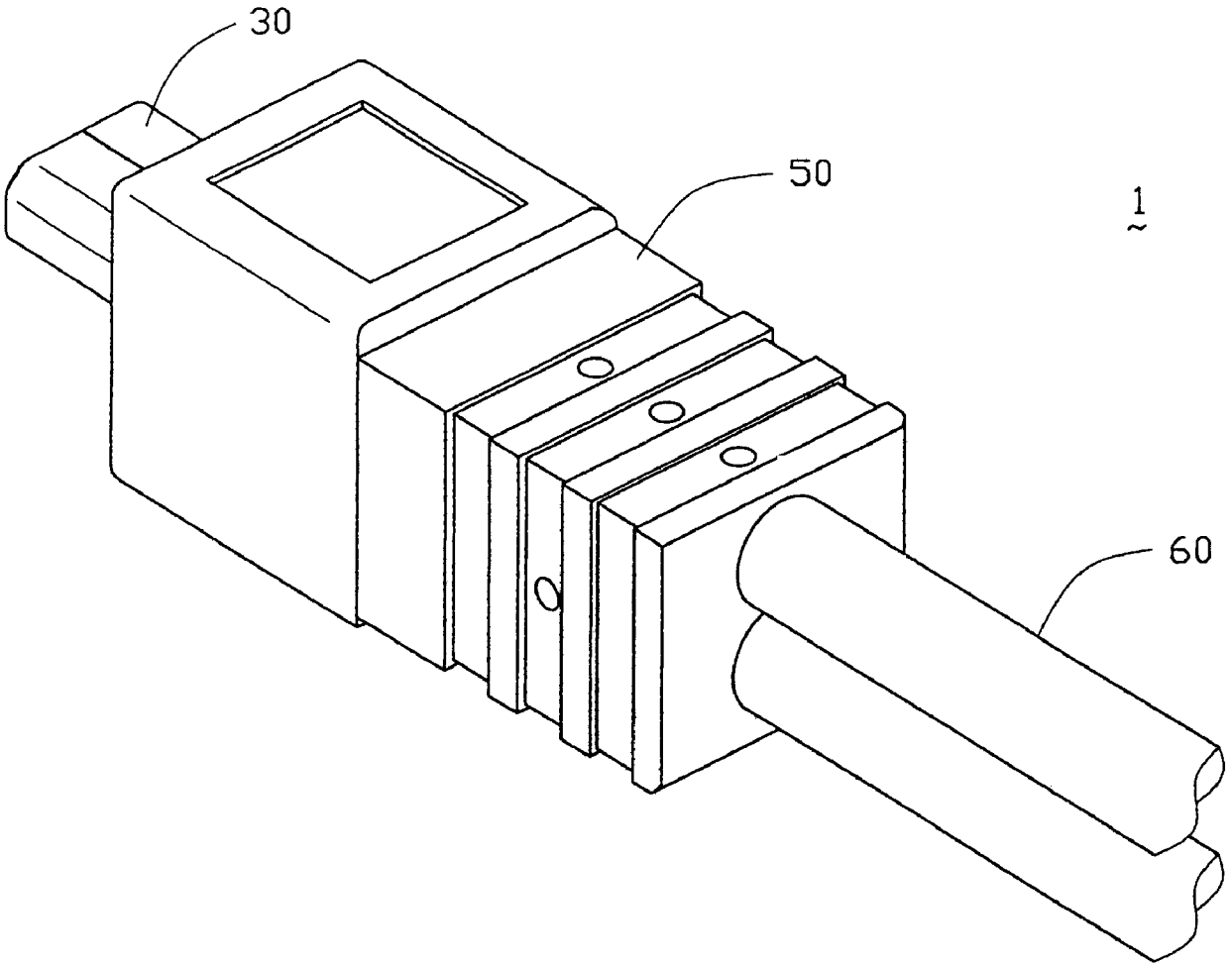
FIG. 1 is a perspective view of a cable connector in accordance with the present invention.

Reference will now be made to the drawing figures to describe the present invention in detail.

Figure 2:
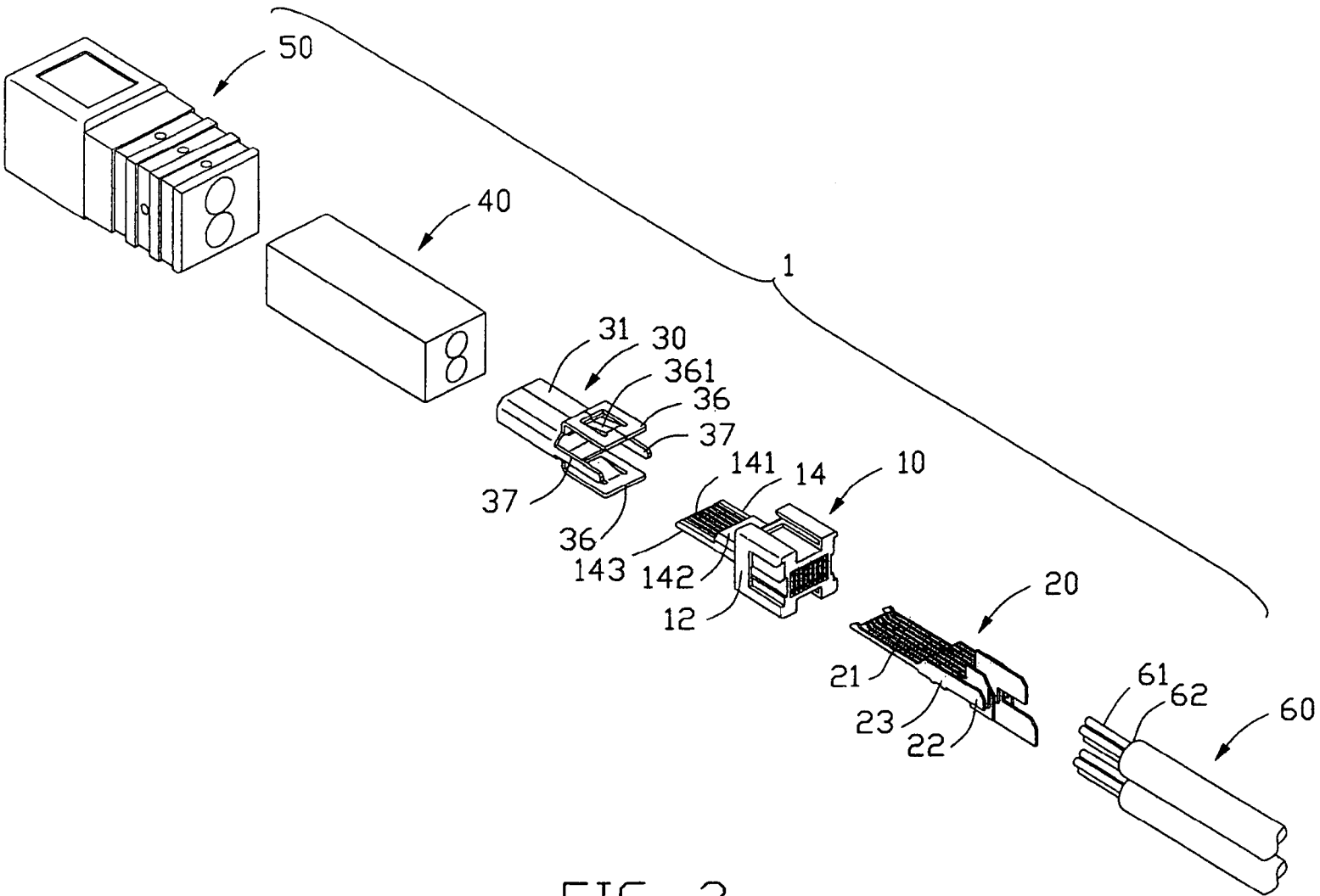
FIG. 2 is an exploded, perspective view of the cable connector shown in FIG. 1.

With reference to FIG. 1 and FIG. 2, a cable connector 1 in accordance with the present invention comprises an insulative housing 10, a terminal set 20 received in the insulative housing 10, a metal shell 30 assembled to the insulative housing 10, an internal insulative shell 40, an external insulative shell 50, and two cables 60.

Figure 3:
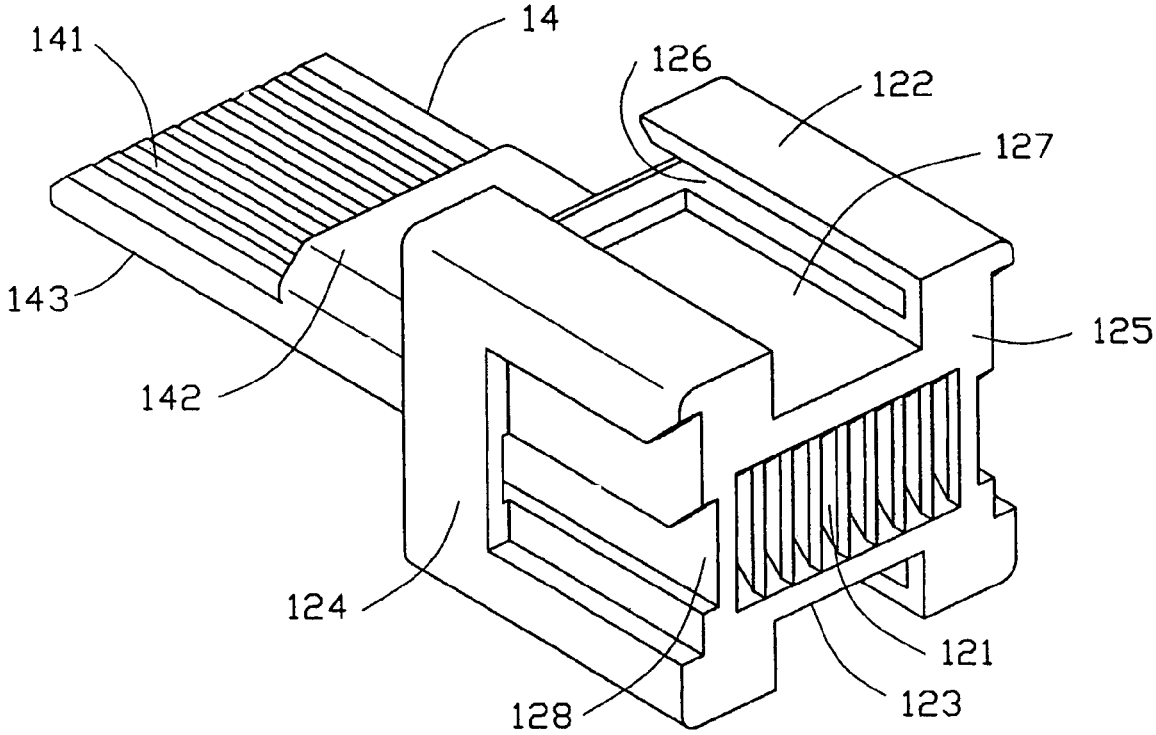
FIG. 3 is a perspective view of a insulative housing of the cable connector shown in FIG. 1.

With reference to FIG. 2 and FIG. 3, the insulative housing 10 comprise a base portion 12 and a tongue 14 extending forwardly from the center of the base portion 12. The base portion 12 comprises a plurality of terminal channels 121 extending therethrough, and a top wall 122, a bottom wall 123 and a pair of side walls 124, 125. The terminal channels 121 arranged in a row and have the same configuration. The top wall 122 has a pair of retaining slots 126 and a depressed portion 127 defined between the retaining slots 126. The bottom wall 123 has a similar structure with the top wall 122. Each side wall 124, 125 defines a passageway 128 extending to a front face of the base portion 12. The tongue 14 comprises a mating portion 143 and a retaining portion 142 next to the mating portion 143. A plurality of terminal slits 141 are defined along the tongue 14 communicating with corresponding terminal channels 121.

Figure 4:
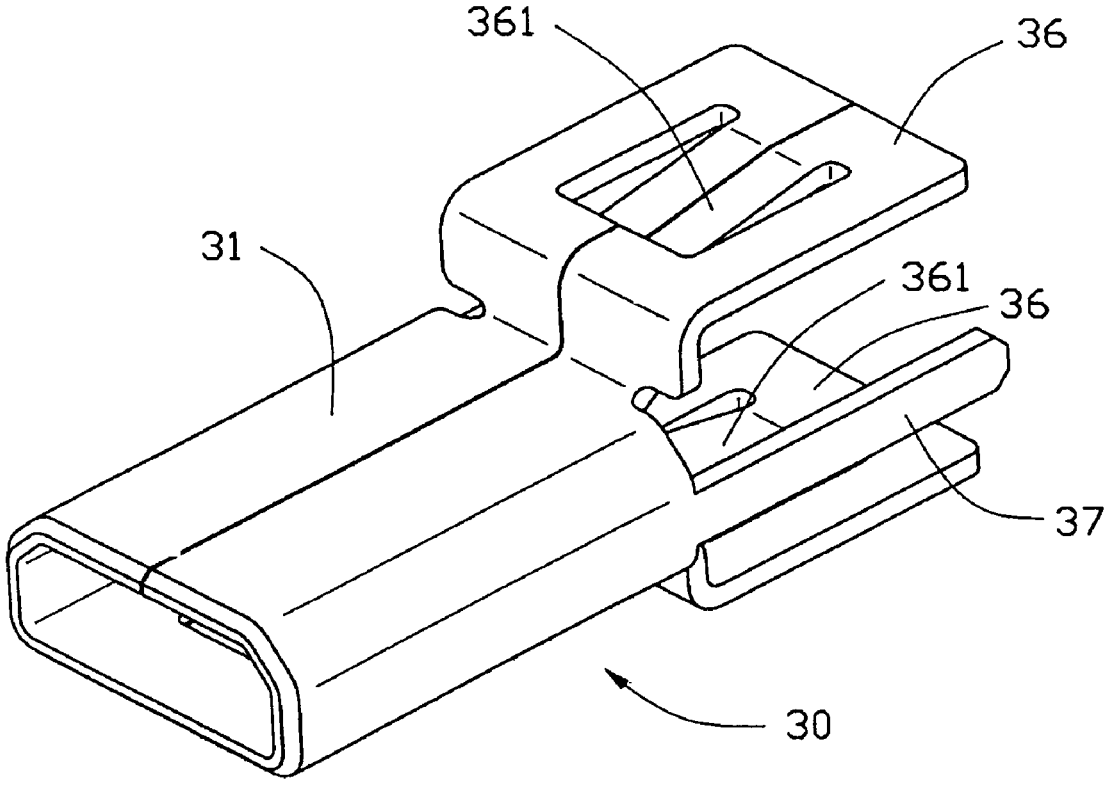
FIG. 4 is a perspective view of a metal shell of the cable connector shown in FIG. 1.

With reference to FIG. 4, the metal shell 30 comprises a main body 31, a pair of retaining portions 36 extending backwardly from upper and lower rear edges of the main body 31, and a pair of arms 37 extending backwardly from rear side edges the main body 31. Each retaining portion 36 defines a resilient clip 361 thereon.

Figure 5:
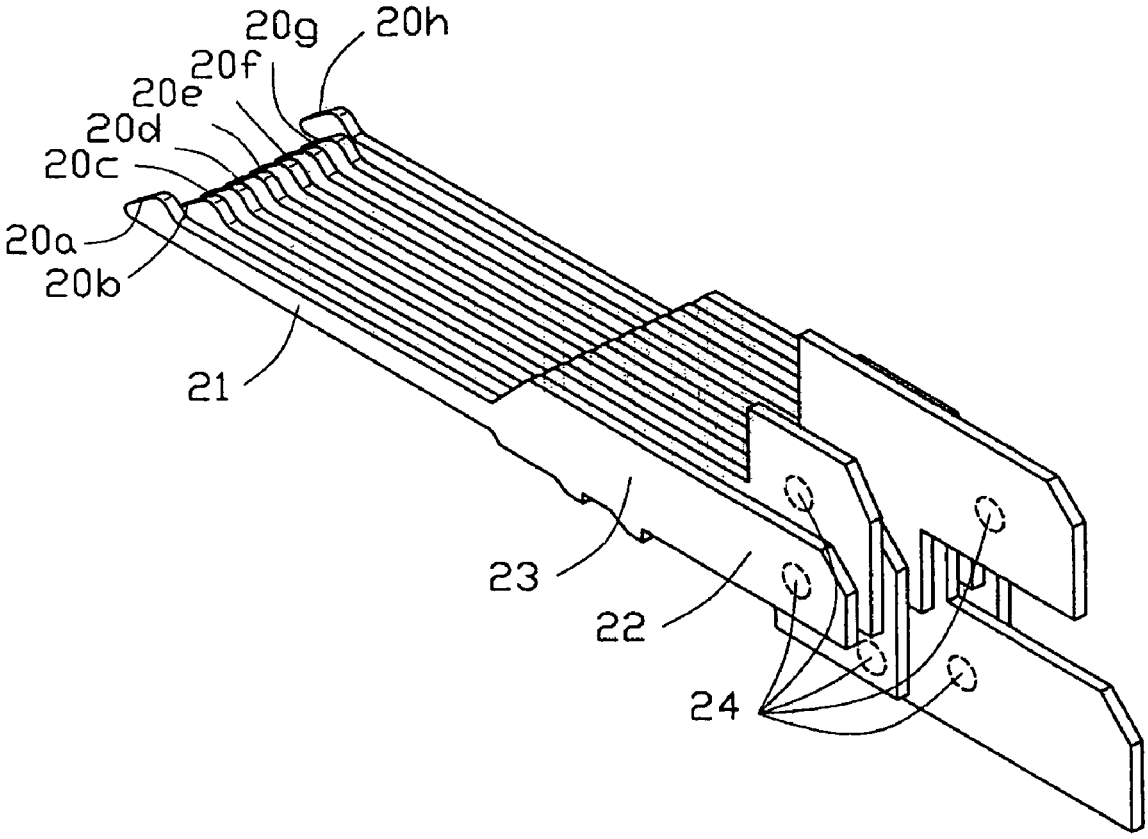
FIG. 5 is a perspective view of a terminal set of the cable connector shown in FIG. 1.

Referring to FIG. 5, the terminal set 20 comprises eight terminals labeled by 20*a* to 20*h*, respectively. Each terminal 20 comprises a contacting portion 21 for electrically connecting with a complementary connector (not shown), an intermediate portion 23 extending backwardly from the contacting portion 21, and a tail portion 22 extending backwardly from the intermediate portion 21. The contacting portions 21 and the intermediate portions 23 of the terminal set 20 are in a same plane. The two terminals 20*a*, 20*h* located at opposite sides of the terminal set 20 are power terminals, and the other terminals of the terminal set 20 are signal terminals. The power terminal has a longer contacting portion 21 and the same intermediate portion 23 with the signal terminal. The tail portions 22 of the power terminals 20*a*, 20*h* are the same. Each tail portion 22 of the terminal set 20 defines a soldering portion 24 thereon for connecting with the cables 60. The soldering portions 24 of the signal terminals respectively, extend upwardly, downwardly and backwardly relative to the soldering portions 24 of the terminals 20*a*, 20*h*. The soldering portion 24 of the signal terminal 20*b* is positioned above the tail portion 22 of the power terminal 20*a*. The soldering portion 24 of the signal terminal 20*c* is positioned under the tail portion 22 of the power terminal 20*a*. The soldering portion 24 of the signal terminal 20*d* is positioned behind and above the tail portion 22 of the terminal 20*a*. Similarly, the soldering portion 24 of the terminal 20*e* is positioned under the tail portion 22 of the terminal 20*h*, the soldering portion 24 of the terminal 20*f* is positioned above the tail portion 22 of the terminal 20*h*, the soldering portion 24 of signal terminal 20*g* is positioned behind and under the tail portion 22 of the terminal 20*h*. Accordingly, the soldering portions 24 of the eight terminals 20 are staggered with each other.

Referring back to FIG. 2, each cable 60 comprises an insulative layer 62 and four conductors 61 received in the insulative layer 62.

Figure 6:
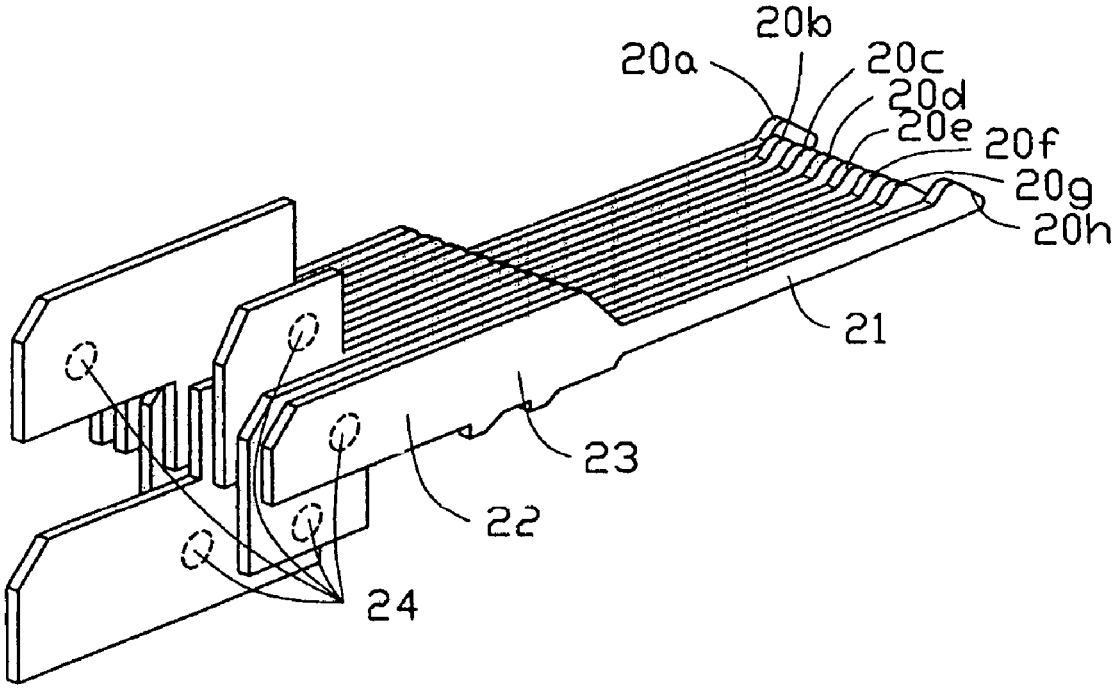
FIG. 6 is another perspective view of a terminal set of the cable connector shown in FIG. 1.
Figure 7:
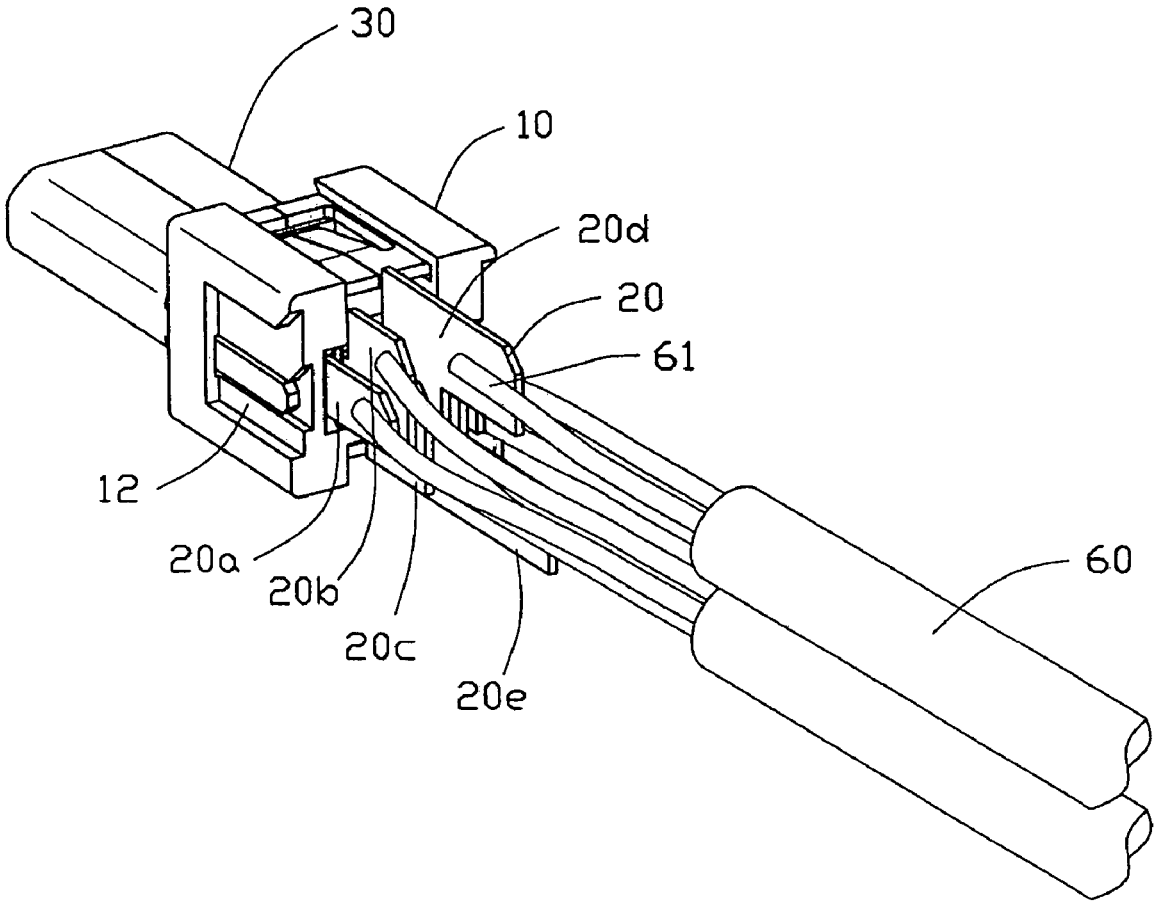
FIG. 7 is a perspective view of the cable connector with an internal insulative shell and an external insulative shell of the cable connector shown in FIG. 1 removed.

In assembly, also referring to FIG. 6, the terminals 20 are inserted into the terminal channels 121 of the insulative housing 10 in a back-to-front direction. The contacting portion 21 of each terminal 20 is received in the terminal slit 141 of the tongue 14, and exposed on the mating portion 143. The intermediate portion 23 of each terminal 20 is located in the retaining portion 142 of the tongue 14. The tail portion 22 of each terminal 20 projects beyond the rear face of the insulative housing 10. The conductors 61 of the cables 60 are soldered to the soldering portions 24 of the tail portions 22 of the terminals 20. The metal shell 30 is assembled on the insulative housing 10 in a front-to-back direction. The retaining portions 36 of the metal shell 30 are engaged with the retaining slots 126 of the insulative housing 10 with the resilient clips 361 thereof engaging with the depressed portions 127. The arms 37 extend into the passageways 128 of the insulative housing 10. The main body 31 of the metal shell 30 encloses the tongue 14 of the insulative housing 10. The internal insulative shell 40 is insert-molded on the base portion 12 of the insulative housing 10, the tail portions 22 of the terminals 20, and the conductors 61 of the cables 60. The external insulative shell 50 is finally over-molded on the internal shell 40 and the cables 60.

As the soldering portions 24 of the tail portions 22 of the terminals 20 are positioned at different height, even the distance between the terminals 20 remains small, the distance between adjacent soldering portions 24 may still be significantly increased. Thus, the conductors 61 of the cable 60 can be easily soldered to the terminals 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A cable connector comprising:

an insulative housing;

at least four signal terminals disposed in the insulative housing, each terminal comprising a mating portion configured in one row with one another along a lateral direction to mate with a complementary connector, and a rear tail portion, the tail portion extending rearward beyond the insulative housing, the tail portions of adjacent terminals being configured different from each other; and a cable having conductors soldered to corresponding tail portions of the adjacent terminals at different positions in at least either a vertical direction or a front-to-back direction both perpendicular to said lateral direction; wherein said different positions of the tail portions of all of said at least four the terminals are arranged in both said front-to-back direction and said vertical direction.

2. The connector as claimed in claim 1, wherein said tails of the adjacent terminals are dimensioned differently.

3. The connector as claimed in claim 1, wherein said tails of the adjacent terminals extend rearward with different lengths along said front-to-back direction.

4. The connector as claimed in claim 1, wherein the tails of some terminals for soldering are vertically arranged in steps.

5. The connector as claimed in claim 1, wherein said terminals are juxtaposed with one another along said lateral direction, and the tail defines a plane, to which the conductor is fixed, being perpendicular to said lateral direction.

6. The cable connector as claimed in claim 1, wherein each of said tail portions has at least one portion overlapped with those of all the others in both said vertical and front-to-back directions, and one of said different positions is located on said portion.

7. The cable connector as claimed in claim 1, wherein in a group of every three of said terminals which are intimately neighboring with one another, with regard to the tail portion of a center one terminal, the adjacent tail portion on a right hand side thereto has a different position with regard to the adjacent tail portion on a left hand side thereto along either the vertical direction or the front-to-back direction.

8. The cable connector as claimed in claim 1, wherein the tail portions of all the terminals have different positions with one another along either the vertical direction or the front-to-back direction.

9. The cable connector as claimed in claim 1, wherein there are three different positions in the vertical direction.

10. The cable connector as claimed in claim 1, wherein the tail portion of each of said terminals is not vertically aligned with that of either adjacent terminal by either side thereof, but spaced from each other in said lateral direction.

11. A cable connector comprising:

an insulative housing;

at least four signal terminals disposed in the insulative housing, each terminal comprising a mating portion configured in one row with one another along a lateral direction to mate with a complementary connector, and a rear tail portion, the tail portion extending rearward beyond the insulative housing, the tail portions of adjacent terminals being dimensioned different from each other; and a cable having conductors soldered to corresponding tail portions of the adjacent terminals at different positions without interference in at least either a vertical direction or a front-to-back direction both perpendicular to said lateral direction; wherein said terminals are juxtaposed with one another along said lateral direction, and the tail defines a plane, to which the conductor is soldered, being perpendicular to said lateral direction; wherein said tails of the adjacent terminals extend rearward with different lengths along said front-to-back direction.

12. The connector as claimed in claim 11, wherein the tails of some terminals for soldering are vertically arranged in steps.

13. The cable connector as claimed in claim 11, wherein each of said tail portions has at least one portion overlapped with those of all the others in both said vertical and front-to-back directions, and one of said different positions is located on said portion.

14. The cable connector as claimed in claim 11, wherein in a group of every three of said terminals which are intimately neighboring with one another, with regard to the tail portion of a center one terminal, the adjacent tail portion on a right hand side thereto has a different position with regard to the adjacent tail portion on a left hand side thereto along either the vertical direction or the front-to-back direction.

15. The cable connector as claimed in claim 11, wherein the tail portions of all the terminals have different positions with one another along either the vertical direction or the front-to-back direction.

16. The cable connector as claimed in claim 11, wherein there are three different positions in the vertical direction.

17. The cable connector as claimed in claim 11, wherein the tail portion of each of said terminals is not vertically aligned with that of either adjacent terminal by either sides thereof, but spaced from each other in said lateral direction.

18. A cable connector comprising:

an insulative housing;

a plurality of signal terminals disposed in the insulative housing, each terminal comprising a mating portion configured in line with one another to mate with a complementary connector, and a rear tail portion, the tail portion extending rearward beyond the insulative housing, the tail portions of adjacent terminals being dimensioned different from each other; and a cable having conductors fixed to corresponding tail portions of the adjacent terminals at different positions without interference in at least either a vertical direction or a front-to-back direction; wherein said terminals are juxtaposed with one another along a lateral direction which is perpendicular to said vertical direction and said front-to-back direction, and the tail defines a plane, to which the conductor is fixed, being perpendicular to said lateral direction; wherein there are at least three said terminals, and the tail portions of all said at least three terminals have different positions in both said vertical direction and said front-to-back direction with one another.

19. The cable connector as claimed in claim 18, wherein there are either at least three of said different positions in the vertical direction and at least two of said different positions in the front-to-back directions.

20. The cable connector as claimed in claim 18, wherein all conductors are fixed to the corresponding tail portions facing in the same lateral direction.

* * * * *